US008318617B2

(12) United States Patent
Blankenbeckler

(10) Patent No.: US 8,318,617 B2
(45) Date of Patent: Nov. 27, 2012

(54) CONTAMINATION CONTROL GARMENTS

(75) Inventor: Nicole L. Blankenbeckler, Richmond, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/266,803

(22) Filed: Nov. 7, 2008

(65) Prior Publication Data

US 2009/0119824 A1 May 14, 2009

Related U.S. Application Data

(60) Provisional application No. 61/002,689, filed on Nov. 9, 2007.

(51) Int. Cl.
*B32B 5/26* (2006.01)
*D04H 3/00* (2012.01)

(52) U.S. Cl. ..... 442/334; 442/1; 442/268; 442/319

(58) Field of Classification Search ..... 2/82, 87, 2/69, 456; 442/85, 90, 1, 268, 319, 334
See application file for complete search history.

(56) References Cited

U.S. PATENT DOCUMENTS

| | | | | |
|---|---|---|---|---|
| 4,041,203 | A | 8/1977 | Brock et al. | |
| 4,127,706 | A | 11/1978 | Martin et al. | |
| 4,374,888 | A | 2/1983 | Bornslager | |
| 4,536,361 | A | 8/1985 | Torobin | |
| 5,591,278 | A | 1/1997 | Marcu | |
| 5,784,717 | A | 7/1998 | Singer | |
| 6,183,670 | B1 | 2/2001 | Torobin et al. | |
| 6,315,806 | B1 | 11/2001 | Torobin et al. | |
| 6,382,526 | B1 | 5/2002 | Reneker et al. | |
| 6,491,776 | B2 | 12/2002 | Alper et al. | |
| 6,520,425 | B1 | 2/2003 | Reneker | |
| 6,695,992 | B2 | 2/2004 | Reneker | |
| 6,815,382 | B1 * | 11/2004 | Groten et al. | 442/340 |
| 2003/0129909 | A1 | 7/2003 | Zucker | |
| 2004/0116028 | A1 * | 6/2004 | Bryner | 442/381 |
| 2006/0084340 | A1 | 4/2006 | Bond et al. | |
| 2007/0166503 | A1 * | 7/2007 | Hannigan | 428/59 |
| 2008/0216205 | A1 | 9/2008 | Conley et al. | |

FOREIGN PATENT DOCUMENTS

| | | |
|---|---|---|
| EP | 1953286 | 1/2008 |
| GB | 2218320 | 5/1988 |
| WO | WO 03/080905 | 10/2003 |

OTHER PUBLICATIONS

PCT International Search Report and Written Opinion for International Application No. PCT /US2008/ 082769 dated: Nov. 7, 2008.

* cited by examiner

*Primary Examiner* — Matthew Matzek

(57) ABSTRACT

A cleanroom garment containing a nanoweb bonded in a face to face relationship with a fabric, and a second fabric. The garment has a permeability of at least 1 $m \cdot min^{-1} \cdot m^{-2}$, and a particle filtration efficiency according to IEST-RP-CC003.3 at 0.5 microns of at least 90% after one wash and at least 50% after 25 washes.

7 Claims, No Drawings

CONTAMINATION CONTROL GARMENTS

CROSS-REFERENCE TO RELATED APPLICATION

This application claims priority under 35 U.S.C. §119 from U.S. Provisional Application Ser. No. 61/002,689 (filed Nov. 9, 2007), the disclosure of which is incorporated by reference herein for all purposes as if fully set forth.

FIELD OF THE INVENTION

The present invention relates generally to the field of contamination control apparel, and more specifically to a reusable contamination control garment having improved barrier properties and improved comfort.

BACKGROUND

Cleanrooms are widely used for the manufacture, assembly and packaging of sensitive products and components where it is necessary for the various processes to be conducted in a controlled environment substantially free of particles and other potential contaminants. As such, cleanrooms are typically a confined environment in which humidity, temperature, and particulate matter are precisely controlled to protect the sensitive products and components from contamination by dirt, molds, viruses, noxious fumes and other potentially damaging particles.

Contamination control garments, such as disposable smocks, jumpsuits, gloves, shoe coverings, and hair coverings, are required apparel for the performance of many jobs. Some of the jobs requiring safety garments are performed in cleanroom environments, where the introduction of foreign matter must be minimized. For example, technicians in certain sensitive medical fields dealing with infectious matter, and working with ultrapure materials all wear contamination control garments in cleanroom environments. These garments perform the dual function of protecting the wearer from potentially hazardous materials and prevent unwanted matter from the wearer's person from contaminating the work product.

Disposable contamination control garments for use in clean room environments are typically made from nonwoven disposable materials, such as from sheets of spunbond/melt blown/spunbond (SMS) material and the like. Such sheets of material are cut into patterns and stitched together to form desired contamination control apparel.

Reusable contamination control garments are typically made from tightly woven continuous filament fibers. In some cases these wovens are calendered to improve the barrier properties. Continuous filament fibers are used as they tend to produce less particulates on washing.

Nonwoven fabric laminates are useful for a wide variety of applications. Particularly, nonwoven fabric laminates are useful for wipers, towels, industrial garments, medical garments, medical drapes, sterile wrap, and the like. Fabric laminates, such as spun SMS fabric laminates, made of isotactic polypropylene have achieved widespread use in operating rooms for drapes, gowns, towels, sterile wraps, foot covers, and the like. Such fabric laminates are well known as shown in U.S. Pat. No. 4,041,203 to Kimberly-Clark. Such SMS fabric laminates have outside spun-bonded layers which are durable and an internal melt-blown barrier layer which is porous yet which inhibits the penetration of fluids and bacteria through the composite fabric laminate. The layers are thermally bonded together by spot bonding in discrete areas of the fabric.

Broadly defined, particles may be any minute object in solid or liquid state with clearly defined boundaries, i.e., a clearly defined contour. Such particles may be dust, human skin or hair, or other debris. On a relative order of magnitude, a human will regularly shed 100,000 to 5000,000 particles of a size of 0.3 micrometer or larger, per minute. In some environments, such particles may be microorganisms or viable particles (i.e., single-cell organisms capable of multiplication, at an appropriate ambient temperature, in the presence of water and nutrients). These viable particles may include bacteria, moulds, yeasts and the like. Particles may come from the outside atmosphere, air conditioning systems, and liberation within the cleanroom by processes or by those who use the room. Every article and person that is brought into the cleanroom brings with it the potential of introducing such contaminants into the room.

The classification of cleanrooms by the ISO standards is based on the maximum number of particles of a certain size that can be present. For example, in microchip manufacturing, the cleanrooms are generally certified as ISO Class 3 environments. An ISO Class 3 environment may only have a maximum of 8 particles per cubic meter that are 1 micrometer or larger; 35 particles per cubic meter that are 0.5 micrometers or larger; 102 particles per cubic meter that are 0.3 micrometer or larger; 237 particles per cubic meter that are 0.2 micrometer or larger; and a maximum of 1000 particles per cubic meter that are 0.1 micrometer or larger. ISO Class 4 and 5 environments allow for an incremental increase in the particles present in the cleanroom which may be appropriate for less critical manufacturing environments than is necessary in ISO Class 3 environments.

Conventional SMS fabric laminates made of isotactic polypropylene have not achieved widespread use as garments and protective coverings in more demanding cleanrooms, particularly sterile cleanrooms, and in paint rooms because of the higher requirements for such uses and such SMS fabric laminates tend to emit particles after laundering, either particles from the fabric itself or by passage of particles from the wearer to the atmosphere. The present invention describes a fabric that overcomes the shortcomings of conventional laminates in this regard.

SUMMARY OF THE INVENTION

The present invention is directed to a reusable contamination control garment comprising a nanoweb aligned in a face to face relationship between first and second fabrics, said garment having an air permeability of at least 1 $cm^3 \cdot sec^{-1} \cdot cm^{-2}$, and a particle filtration efficiency at 0.5 microns of at least 90% after one wash and at least 50% after 25 washes.

DETAILED DESCRIPTION

The term "ESD fabric" means an electrostatic dissipation fabric that has conductive fibers woven or knitted in to the structure to provide static dissipation. These fabrics are generally used in electronics cleanrooms.

The term "nanofiber" as used herein refers to fibers having a number average diameter or cross-section less than about 1000 nm, even less than about 800 nm, even between about 50 nm and 500 nm, and even between about 100 and 400 nm. The term diameter as used herein includes the greatest cross-section of non-round shapes.

The term "nonwoven" means a web including a multitude of randomly distributed fibers. The fibers generally can be bonded to each other or can be unbonded. The fibers can be staple fibers or continuous fibers. The fibers can comprise a single material or a multitude of materials, either as a combination of different fibers or as a combination of similar fibers each comprised of different materials. A "nanoweb" is a nonwoven web that comprises nanofibers.

"Calendering" is the process of passing a web through a nip between two rolls. The rolls may be in contact with each other, or there may be a fixed or variable gap between the roll surfaces. An "unpatterned" roll is one which has a smooth surface within the capability of the process used to manufacture them. There are no points or patterns to deliberately produce a pattern on the web as it passed through the nip, unlike a point bonding roll.

The as-spun nanoweb comprises primarily or exclusively nanofibers, advantageously produced by electrospinning, such as classical electrospinning or electroblowing, and in certain circumstances, by meltblowing or other such suitable processes. Classical electrospinning is a technique illustrated in U.S. Pat. No. 4,127,706, incorporated herein in its entirety, wherein a high voltage is applied to a polymer in solution to create nanofibers and nonwoven mats. However, total throughput in electrospinning processes is too low to be commercially viable in forming heavier basis weight webs.

The present invention is directed towards a reusable contamination control or cleanroom garment that comprises a laminate of a nanoweb aligned between two fabrics. The garment has a permeability of at least 1.0 $cm^3 s^{-1} cm^{-2}$ and a particle filtration efficiency at 0.5 microns of at least 90% after one wash cycle in water plus detergent, and at least 50% after 25 washes. Fabric is a cloth made by weaving, knitting, or felting fibers. As examples of fabrics, tricot, taffeta, or ripstop may be used. Tricot is a plain warp knit fabric, tricot fabric that can be created with an array of fibers and fiber blends, for example cotton, wool, silk rayon or nylon (polyamide.) Taffeta is a plain weave fabric that can be made from natural or synthetic fibers, and ripstop is a fabric woven with a double thread approximately every quarter inch to prevent the expansion of small rips. Other fabrics that can be used in the invention may be apparent to one skilled in the art.

The nanoweb of the invention can be made by any means suitable for making fibers of less than about one micron in diameter. For example, nanofibers can include fibers made from a polymer melt. Methods for producing nanofibers from polymer melts are described for example in U.S. Pat. No. 6,520,425; U.S. Pat. No. 6,695,992; and U.S. Pat. No. 6,382,526 to the University of Akron, U.S. Pat. No. 6,183,670; U.S. Pat. No. 6,315,806; and U.S. Pat. No. 4,536,361 to Torobin et al., and U.S. publication number 2006/0084340. Nanofibers can also be produced by the process of electroblowing.

The "electroblowing" process is disclosed in World Patent Publication No. WO 03/080905, incorporated herein by reference in its entirety. A stream of polymeric solution comprising a polymer and a solvent is fed from a storage tank to a series of spinning nozzles within a spinneret, to which a high voltage is applied and through which the polymeric solution is discharged. Meanwhile, compressed air that is optionally heated is issued from air nozzles disposed in the sides of, or at the periphery of the spinning nozzle. The air is directed generally downward as a blowing gas stream which envelopes and forwards the newly issued polymeric solution and aids in the formation of the fibrous web, which is collected on a grounded porous collection belt above a vacuum chamber. The electroblowing process permits formation of commercial sizes and quantities of nanowebs at basis weights in excess of about 1 gsm, even as high as about 40 gsm or greater, in a relatively short time period.

A substrate or scrim can be arranged on the collector to collect and combine the nanofiber web spun on the substrate, so that the combined fiber web is used as a high-performance filter, wiper and so on. Examples of the substrate may include various nonwoven cloths, such as meltblown nonwoven cloth, needle-punched or spunlaced nonwoven cloth, woven cloth, knitted cloth, paper, and the like, and can be used without limitations so long as a nanofiber layer can be added on the substrate. The nonwoven cloth can comprise spunbond fibers, dry-laid or wet-laid fibers, cellulose fibers, melt blown fibers, glass fibers, or blends thereof.

Polymer materials that can be used in forming the nanowebs of the invention are not particularly limited and include both addition polymer and condensation polymer materials such as, polyacetal, polyamide, polyester, polyolefins, cellulose ether and ester, polyalkylene sulfide, polyarylene oxide, polysulfone, modified polysulfone polymers, and mixtures thereof. Preferred materials that fall within these generic classes include, poly (vinylchloride), polymethylmethacrylate (and other acrylic resins), polystyrene, and copolymers thereof (including ABA type block copolymers), poly (vinylidene fluoride), poly (vinylidene chloride), polyvinylalcohol in various degrees of hydrolysis (87% to 99.5%) in crosslinked and non-crosslinked forms. Preferred addition polymers tend to be glassy (a $T_g$ greater than room temperature). This is the case for polyvinylchloride and polymethylmethacrylate, polystyrene polymer compositions or alloys or low in crystallinity for polyvinylidene fluoride and polyvinylalcohol materials. One preferred class of polyamide condensation polymers are nylon materials, such as nylon-6, nylon-6, 6, nylon 6, 6-6, 10, and the like. When the polymer nanowebs of the invention are formed by meltblowing, any thermoplastic polymer capable of being meltblown into nanofibers can be used, including polyolefins, such as polyethylene, polypropylene and polybutylene, polyesters such as poly (ethylene terephthalate) and polyamides, such as the nylon polymers listed above.

It can be advantageous to add known-in-the-art plasticizers to the various polymers described above, in order to reduce the $T_g$ of the fiber polymer. Suitable plasticizers will depend upon the polymer to be electrospun or electroblown, as well as upon the particular end use into which the nanoweb will be introduced. For example, nylon polymers can be plasticized with water or even residual solvent remaining from the electrospinning or electroblowing process. Other known-in-the-art plasticizers which can be useful in lowering polymer $T_g$ include, but are not limited to aliphatic glycols, aromatic sulphanomides, phthalate esters, including but not limited to those selected from the group consisting of dibutyl phthalate, dihexyl phthalate, dicyclohexyl phthalate, dioctyl phthalate, diisodecyl phthalate, diundecyl phthalate, didodecanyl phthalate, and diphenyl phthalate, and the like. The *Handbook of Plasticizers*, edited by George Wypych, 2004 Chemtec Publishing, incorporated herein by reference, discloses other polymer/plasticizer combinations which can be used in the present invention.

The as-spun nanoweb of the present invention can be calendered in order to impart the desired physical properties to the fabric of the invention, as disclosed in co-pending U.S. patent application Ser. No. 11/523,827, filed Sep. 20, 2006 and incorporated herein by reference in its entirety.

The average fiber diameter of the nanofibers deposited by the electroblowing process is less than about 1000 nm, or even less than about 800 nm, or even between about 50 nm to about 500 nm, and even between about 100 nm to about 400 nm. Each nanofiber layer has a basis weight of at least about 1 g/m$^2$, even between about 1 g/m$^2$ to about 40 g/m$^2$, and even between about 5 g/m$^2$ to about 20 g/m$^2$, and a thickness between about 20 μm to about 500 μm, and even between about 20 μm to about 300 μm.

The nonwoven materials and the fabrics can be bonded to one another by various bonding techniques during or after spinning of the nanoweb. Many bonding techniques known to those skilled in the art are suitable for bonding the fabrics of the presently disclosed invention, such as thermal bonding, adhesive bonding, ultrasonic bonding, point bonding, vacuum lamination, mechanical bonding, solvent bonding and chemical bonding.

Thermal bonding includes the application of heat and pressure to two surfaces in order to bring about such physical changes as are necessary to cause the surfaces to adhere to the required degree. Such heat and pressure generally are applied using the nip between a pair of rolls. Thermal bonding also may include adhesive bonding, in which one or both of the surfaces has adhesive applied to it in the places where it is desired that bonding take place. Generally, the presence of an adhesive permits milder temperature and pressure bonding conditions to adequately form a bond. In addition, the materials to be bonded may be coated or otherwise contacted with a pressure or temperature sensitive adhesive, where bonding is achieved upon application of the appropriate energy (heat or pressure).

Ultrasonic bonding typically entails a process performed, for example, by passing a material between a sonic horn and an anvil roll such as illustrated in U.S. Pat. Nos. 4,374,888 and 5,591,278, the disclosures of which are incorporated by reference herein in their entireties. In an exemplary method of ultrasonic bonding, the various layers that are to be bonded to one another may be simultaneously fed to the bonding nip of an ultrasonic unit. A variety of these units are available commercially. In general, these units produce high frequency vibration energy that melt thermoplastic components at the bond sites within the layers and join them together. Therefore, the amount of induced energy, speed by which the combined components pass through the nip, gap at the nip, as well as the number of bond sites determine the extent of adhesion between the various layers. Very high frequencies are obtainable, and frequencies in excess of 18,000 cps (cycles per second) usually are referred to as ultrasonic, however, depending on the desired adhesion between various layers and the choice of material, frequencies as low as 5,000 cps or even lower may produce an acceptable bond. To maintain a permeable structure the ultrasonic bonding must be discontinuous.

Point bonding typically includes bonding one or more materials together at a plurality of discrete points. For example, thermal point bonding generally involves passing one or more layers to be bonded between heated rolls that include, for example, an engraved pattern roll and a smooth calender roll. The engraved roll is patterned in such a manner that the entire fabric is not bonded over its entire surface, and the calender roll is usually smooth. As a result, various patterns for engraved rolls have been developed for functional as well as aesthetic reasons.

Adhesive lamination usually refers to any process that uses one or more adhesives that are applied to a web to achieve a bond between two webs. The adhesive can be applied to the web by means such as coating with a roll, spraying, or application via fibers. Examples of suitable adhesives are provided in U.S. Pat. No. 6,491,776, the disclosure of which is incorporated herein by reference in its entirety. Preferably when using adhesive lamination a discontinuous pattern is used, such as by gravure coating. If a continuous layer of adhesive is used the laminate may completely loss it's air permeability. Also preferable for contamination control laminates is the use of hot melt adhesive as it would have low residual volitale organic compounds (VOCs). VOCs left in the adhesive from a solvent based process can be an issue for some electronic cleanrooms.

Test Methods

Basis Weight (BW) was determined by ASTM D-3776, which is hereby incorporated by reference and reported in g/m$^2$ (gsm).

Fiber Diameter was determined as follows. Ten scanning electron microscope (SEM) images at 5,000× magnification were taken of each fine fiber layer sample. The diameter of eleven (11) clearly distinguishable fine fibers were measured from the photographs and recorded. Defects were not included (i.e., lumps of fine fibers, polymer drops, intersections of fine fibers). The average (mean) fiber diameter for each sample was calculated.

Contamination control garments are generally tested for performance per IEST-RP-CC003.3 "Garment System Considerations for Cleanrooms and Other Controlled Environments", hereby incorporated in its entirety by reference, which is a recommended practice that is published by the Institute of Environmental Sciences and Technology (IEST). The examples show here per IEST standards were tested at RTI International (Research Triangle Park, N.C.).

Particle filtration efficiency (PFE) was determined according to IEST-RP-CC003.3 appendix B1.1 at 0.5 microns, which is hereby incorporated by reference and reported in % of particles removed. In this test a section of the fabric is clamped in holder and controlled, particle challenged air is passed through it at a constant pressure drop across the fabric. The ability of the fabric to filter particles generated by the wearer is determined by testing the air on both sides of the fabric with an automatic particle counter.

Fiber shed was determined according to IEST-RP-CC003.3, appendix B2.3, which is hereby incorporated by reference and reported in counts of particles per 0.1 m$^2$ of sample. In this method a section of the fabric is placed over a screen and vacuumed at a constant pressure. The air is then filtered to collect the particles for counting.

Air Permeability (AP) was determined by ASTM D-737 at 125 Pa, which is hereby incorporated by reference and reported in cm$^3$/sec/cm$^2$.

Example 1

A two-layer fabric construction was made from a 70 denier, 60 gsm, DWR nylon taffeta fabric (available from Rose City Textiles, Portland, Oreg.) and a nanoweb made from Nylon 6, 6 with a basis weight of 10 gsm (grams per square meter), an average fiber diameter of 421 nm and an air perm of 110 L/m2/sec at 125 Pa (available from Dupont) Wilmington, Del.). The nylon woven fabric was laminated to the nanoweb using a hot melt reactive urethane adhesive. The adhesive was applied using a dot pattern, 45% coverage gravure-roll applicator at 135° C. with an applicator pressure of 276 kPa (gauge) and a lines speed of 2.8 mpm. The two layer construction was then laminated by the same process to an additional layer of 70 denier, 60 gsm, DWR nylon taffeta to make a three layer structure of taffeta/nanoweb/taffeta. The laminate was then cut and sewn into squares for testing.

The swatches were sewn into 38 cm squares with continuous filament thread using seam type Seam type EFb-1 (per ASTM D6193-97). The samples were laundered (wash/dry) at a commercial contamination control laundry (Prudential, Richmond, Va.). They were then evaluated for particle filtration efficiency, particle shed and air permeability.

Example 2

A three layer fabric construction was created as in example 1 except that the last layer of the laminate was a 66 gsm nylon tricot (Rose City Textiles, Portland, Oreg.).

Example 3

A three-layer fabric construction made as in example 1 except that both outer layers were a nylon tricot fabric (available from Rose City Textiles).

Example 4

A three-layer fabric construction was made as in example 1 except that the first layer was a nylon tricot and the last layer was a 70 denier 60 gsm, DWR nylon taffeta fabric (Rose City Textiles)

Example 5

As example 1 except that the two-layer fabric construction was produced by laminating the nylon woven fabric to the nanoweb using a solvent based reactive urethane adhesive. The adhesive was applied using a dot pattern, 45% coverage gravure-roll with an applicator pressure of 276 kPa (gauge) and a lines speed of 2.9 mpm. Then the two layer construction was laminated by the same process to an additional layer of nylon tricot to make a three layer structure of taffeta/nylon nanoweb/tricot.

Example 6

Example 6 was an ultrasonically laminated, taffeta/nanoweb/taffeta. A three-layer fabric construction made from a 51 gsm, nylon taffeta fabric and a nanoweb made from Nylon 6,6, with a basis weight of 11 gsm (grams per square meter) and an average fiber size of 430 nm and another layer of the taffeta. The three layers were collated and ultrasonically bonded at Beckmann Converting (Amsterdam, N.Y.). The pattern used was a dot pattern.

Example 7

Example 7 was an ultrasonically laminated, taffeta/nanoweb/tricot, constructed as example 6. The tricot used had a basis weight of 36 gsm.

Comparative Example

Commercial Control

A 102 gsm commercially available contamination control Electrostatic Discharge (ESD) fabric available from Precision Fabrics Group, (Greensboro, N.C.).

TABLE

| | Filtration Eff. (0.5μ particles %) | | Particle shed 0.5μ particles (per 0.1 $m^2$) | | Air Perm. ($cm^3/cm^2/sec$) | |
|---|---|---|---|---|---|---|
| Example | 1 wash | 26 wash | 1 wash | 26 wash | 1 wash | 26 wash |
| 1 | 98.9 | 79.6 | 90 | 73 | 3.5 | 4.0 |
| 2 | 97 | 48.5 | 169 | 39 | 6.0 | 8.5 |
| 3 | 98.7 | 84.1 | 33 | 17 | 11.1 | 16.7 |
| 4 | 98 | 53.5 | 39 | 27 | 6.1 | 11.2 |
| 5 | 97.8 | 84.8 | 39 | 24 | 3.8 | 8.4 |
| 6 | 99.2 | 98.3 | 225 | 50 | 5.2 | 4.6 |
| 7 | 90.2 | 64.1 | 62 | 27 | 9.6 | 15.7 |
| Comparative | 35.5 | 27.7 | 63 | 65 | 1.4 | 1.4 |

All of the samples with similar face fabrics on the outside layers (1, 3, 6) are effective at maintaining barrier performance after washing. However, the solvent lamination of the assymetrical structure (example 5) was also effective after washing.

Although the present invention has been described with respect to various specific embodiments, various modifications will be apparent from the present disclosure and are intended to be within the scope of the following claims.

I claim:

1. A reusable contamination control garment comprising an as spun nanoweb with a basis weight of between 2 and 50 grams per square meter aligned in a face to face relationship between first and second fabrics, and bonded to either or both of the fabrics wherein the first and second fabrics are a cloth made by weaving or knitting fibers, said garment having an air permeability of at least 1.0 $cm^3\ s^{-1}\ cm^{-2}$ and a particle filtration efficiency at 0.5 microns of at least 90% after one wash and at least 50% after 25 washes.

2. The garment of claim 1 wherein the first and second fabrics are independently taffeta, tricot or ripstop.

3. The garment of claim 1 wherein one or both of the first or second fabrics is an electrostatic dissipation fabric.

4. The garment of claim 1 wherein the nanoweb is bonded to a scrim that is bonded to one of the first or second fabrics.

5. The garment of claim 1 wherein the nanoweb is spun directly onto a scrim and the scrim plus nanoweb structure is bonded between the first and second fabrics.

6. The garment of claim 1 wherein the first and second fabrics are independently bonded to the nanoweb by a process selected from the group consisting of adhesive bonding, solvent bonding, and ultrasonic bonding.

7. The garment of claim 1 wherein the as spun nanoweb is calendered.

* * * * *